US005093398A

United States Patent [19]

Röttger et al.

[11] Patent Number: 5,093,398

[45] Date of Patent: Mar. 3, 1992

[54] DISPERSIONS OF COPOLYMERS CONTAINING PERFLUOROALKYL GROUPS

[75] Inventors: Jutta Röttger, Cologne; Karl-Heinz Passon; Werner Maurer, both of Leverkusen; Rolf-Volker Meyer, Krefeld; Wilfried Kortmann, deceased, late of Nachrodt-Wiblingswerde, by Margot Kortmann, Bettina Kortmann, Axel Kortmann, heirs; Peter Selinger, Leverkusen, all of Fed. Rep. of Germany

[73] Assignee: Bayer Aktiengesellschaft, Leverkusen, Fed. Rep. of Germany

[21] Appl. No.: 592,142

[22] Filed: Oct. 3, 1990

[30] Foreign Application Priority Data

Oct. 27, 1989 [DE] Fed. Rep. of Germany ..... 3935859

[51] Int. Cl.[5] ..... C08K 5/11; C08F 214/18; C08F 220/68; C08F 228/02; C08F 220/20; C08F 222/18

[52] U.S. Cl. ..... 524/322; 524/319; 526/243; 526/245; 526/286; 526/329.4; 526/323

[58] Field of Search ..... 524/322, 319

[56] References Cited

U.S. PATENT DOCUMENTS 2,803,615 8/1957 Ahlbrecht et al. ..... 524/805
4,818,621 4/1989 Kuroda et al. ..... 428/424.6

*Primary Examiner*—Joseph L. Schofer
*Assistant Examiner*—Wu C. Cheng
*Attorney, Agent, or Firm*—Sprung Horn Kramer & Woods

[57] ABSTRACT

Aqueous dispersions of copolymers and graft copolymers of ethylenically unsaturated perfluoroalkyl monomers having at least 6 C atoms in the perfluorinated chain and ethylenically unsaturated monomers containing no perfluoroalkyl groups, which additionally contain certain ester compounds which cannot be used as comonomers, are outstandingly suitable for finishing textile materials, leather and the like. Excellent oleophobic and hydrophobic effects are obtained.

5 Claims, No Drawings

DISPERSIONS OF COPOLYMERS CONTAINING PERFLUOROALKYL GROUPS

Aqueous dispersions of copolymers and graft copolymers prepared by co-using perfluoroalkyl (meth)acrylates have been described in many instances in the literature (compare, for example, JP-A-83/59,277, BE-A-677,859, DE-A-3,407,361, DE-A-3,407,362, DE-A-1,953,345 and DE-A-1,953,349) and are used as phobizing agents on many substrates.

The use of alkyl (meth)acrylates as comonomers in the preparation of perfluoroalkyl copolymer dispersions and the use of these dispersions for textile treatment is also already known (compare, for example, U.S. Pat. Nos. 2,803,615 and 3,062,765), hydrophobizing often also being obtained, in addition to an oleophobic finish.

However, a further improvement in the oleophobic/hydrophobic properties can be achieved with such perfluoroalkyl copolymers only by increasing the fluorine-containing component in the copolymer dispersion.

The price of these advantages, however, is disadvantages such as hardening and sticking, which have adverse effects on the handle of the textiles finished with these compounds.

There was therefore the object of developing highly effective finishing agents which give rise to the desired oleophobic/hydrophobic properties without increasing the fluorine-containing component and which therefore also do not cause the disadvantages described above.

The present invention thus relates to aqueous dispersions of copolymers and graft copolymers of ethylenically unsaturated perfluoroalkyl monomers having at least 6 C atoms in the perfluorinated chain and ethylenically unsaturated monomers containing no perfluoroalkyl groups, characterized in that the dispersions additionally contain ester compounds which contain at least 6 C atoms linked linearly to one another and either contain 1,2-substituted vinylic groups or are free from vinylic groups, and to the use thereof for the treatment of textiles, leather and paper.

The aqueous dispersions have solids contents of copolymers of about 10% by weight to 30% by weight and particle sizes of about 250 to 450 nm.

Suitable perfluoroalkyl monomers are those of the formulae

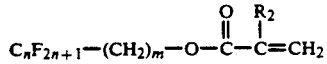

(Ia)

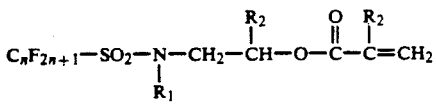

(Ib)

and

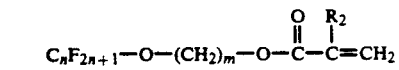

(Ic)

wherein $R_1$ denotes $C_1$–$C_4$-alkyl, $R_2$ denotes hydrogen or methyl, m denotes 1 to 4 and n denotes 4 to 12.

Particularly preferred monomers (I) are those wherein $R_1$ denotes $C_1$–$C_2$-alkyl, $R_2$ denotes hydrogen or methyl, m denotes 2 and n denotes 6 to 8.

Suitable monomers which are free from perfluoroalkyl groups are on the one hand compounds of the general formula

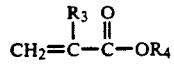

(II)

wherein $R_3$ represents hydrogen, methyl or fluorine and $R_4$ represents a $C_8$–$C_{22}$-alkyl radical.

Preferred monomers (II) are those where $R_3$=H or methyl and $R_4$=a $C_{12}$–$C_{22}$-alkyl radical.

Examples which may be mentioned are: acrylic and methacrylic acid esters of behenyl alcohol, stearyl alcohol, oleyl alcohol, nonyl or octyl alcohol or isomer mixtures of such alcohols.

Suitable monomers containing no perfluoroalkyl groups are moreover compounds of the formulae (III):

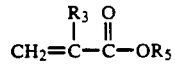

(IIIa)

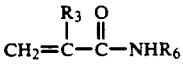

(IIIb)

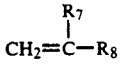

(IIIc)

wherein $R_3$ denotes hydrogen, methyl or fluorine, $R_5$ denotes $C_1$- to $C_7$-alkyl, $R_6$ denotes $C_1$- to $C_7$-alkyl,

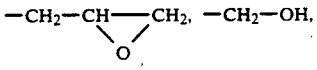

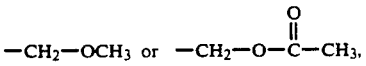

$R_7$ denotes H, $CH_3$, F or Cl, $R_8$ denotes Cl, F, $OR_1$, phenyl,

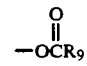

or CN and $R_9$ denotes $C_1$–$C_4$-alkyl.

Particularly preferred monomers (III) are vinyl esters, such as vinyl acetate or vinyl propionate, and acrylic and methacrylic acid esters of $C_1$–$C_4$-alcohols.

Preferred copolymers contain the individual types of comonomers in the proportions listed below:

perfluoroalkyl monomers of the formulae (I)—15 to 70% by weight, preferably 25 to 60% by weight, comonomers of the formula (II)—5 to 35% by weight, preferably 10 to 25% by weight, comonomers of the formulae (III)—15 to 65% by weight, preferably 20 to 55% by weight.

Water-insoluble comonomers are in general preferred, and to ensure a certain adhesion to the various substrates during oleophobic/hydrophobic finishing, water-soluble comonomers can also be used in amounts of up to 10% by weight, preferably up to 2% by weight.

Suitable ester compounds (IV) are:

1) Synthetic or naturally occurring esters and/or partial esters of saturated, unsaturated and/or substituted fatty acids of chain length $C_6$–$C_{22}$ with mono-, di-, tri- and polyols. Preferred fatty acids are oleic acid, stearic acid, arachic acid, behenic acid, palmitic acid, myristic acid, linoleic acid, linolenic acid, lauric acid, eleostearic acid and fatty acids such as are obtained from natural products.

Monohydroxy components which are preferably employed for the preparation of these ester compounds are alkanols having 1 to 22 carbon atoms, such as, for example, methanol, ethanol and propanol, and also, for example, stearyl alcohol and oleyl alcohol. Fatty acid esters of diols contain dihydric alcohols having 4 to 12 carbon atoms, for example 1,4-butanediol, 1,5-pentanediol, 1,6-hexanediol, 1,12-dodecanediol or neopentylglycol.

The trihydroxy compounds as alcohol components of the ester compounds according to the invention include, inter alia, glycerol, trimethylolpropane and cyclohexanetriol. Polyols which can be used are, for example, pentaerythritol, sorbitol and mannitol, as well as monosaccharides, such as glucose and fructose, and oligosaccharides, such as, for example, sucrose, maltose, lactose and raffinose. Suitable naturally occurring esters and partial esters are beef tallow, whale oil, neat's-foot oil, palm oil, olive oil, peanut oil, maize oil, linseed oil, rape oil, soya bean oil, sunflower oil, coconut oil, palm-kernel oil, castor oil and Babussa oil.

2) Esters and/or partial esters of di-, tri- and tetracarboxylic acids with saturated or unsaturated fatty alcohols of chain length $C_6$–$C_{22}$.

Examples which may be mentioned of the carboxylic acid component are dicarboxylic acids having 4 to 10 carbon atoms, such as, for example, sebacic acid, phthalic acid and isophthalic acid, tricarboxylic acids, such as, for example, citric acid and trimellitic acid, and pyromellitic acid as a tetracarboxylic acid.

3) Polyesters based on polyhydric alcohols and polybasic carboxylic acids having molecular weights of about 1,000 to 8,000.

The esters (IV) preferably contain at least 6 C atoms in the chain.

The esters (IV) described under points 1 to 3 can advantageously also be used as mixtures. The ester compounds used according to the invention are known. For the copolymer preparation according to the invention, the ester compounds can be used either directly—since the preparation is carried out by the emulsion polymerization process—but more advantageously in the form of their aqueous emulsions.

The aqueous emulsions contain the ester compounds mentioned in concentrations of 5 to 40% by weight, preferably 10 to 30% by weight. Emulsifiers which can be used to prepare the emulsions can be either non-ionic, anionic or cationic types as well as anionic/non-ionic or cationic/non-ionic combinations of the surface-active compounds, in concentrations of 2 to 25, preferably 5 to 15% by weight, based on the compound to be emulsified, and mixtures thereof. The methods for emulsification are generally known.

To prepare the perfluoroalkyl copolymer dispersions according to the invention, the abovementioned ester compounds are employed in amounts of 2 to 50, preferably 5 to 35, % by weight, based on the total amount of monomers used for the copolymerization.

The aqueous dispersions according to the invention can contain other polymers, such as are described, for example, in DE-A 3,407,361 and 3,407,362, in particular hydrophobic vinyl polymers (V) and/or polycondensates (VI), such as are described, for example, in DE-A 956,990 —if appropriate as a graft base—preferably in amounts of 8% by weight to 30% by weight, based on the copolymer of (I), (II) and (III).

Examples of suitable vinyl polymers (V) are copolymers of (meth)acrylates, such as isobutyl methacrylate or butyl acrylate, which contain at least one comonomer having a hydrophobic alkyl radical, such as, for example, stearyl methacrylate. Examples of suitable polycondensates (VI) are urea resins and melamine resins, such as are obtained, for example, by reaction of hexamethylolmelamine pentamethyl ether with fatty acids and if appropriate with methyldialkanolamine, as described, for example, in EP-A-324,354.

A particular embodiment here is the combination of such a melamine condensate with paraffin fractions or paraffin waxes.

The dispersions according to the invention are prepared in a manner which is known per se, for example by the procedure of emulsion polymerization in water.

It may be advantageous to use auxiliary solvents, which are described, for example: in U.S. Pat. No. 3,062,765, in the copolymerization. It is furthermore possible to use water-immiscible auxiliary solvents, such as alkyl acetates, alkyl propionates or chlorofluorocarbons. The use of ethyl acetate or methyl propionate is particularly advantageous. After conclusion of the polymerization, the auxiliary solvent is removed by distillation.

The emulsions are prepared in stirred units, ultrasonic apparatuses or homogenizers.

The polymerization is triggered off by agents which form free radicals. Suitable agents which form free radicals are, for example, aliphatic azo compounds, such as azodiisobutyronitrile, and organic or inorganic peroxides, these agents being employed in the customary amounts. Organic peroxides which may be mentioned are: diacyl peroxides, such as dibenzoyl peroxide, hydroperoxides, such as tert.-butyl hydroperoxide, and percarbonates, such as dicyclohexyl percarbonate. The alkali metal salts of peroxydisulphuric acid are particularly suitable as inorganic peroxides.

The polymerization temperatures are in general up to 100° C., preferably 50° to 100° C. and in particular 60° to 90° C.

It is also possible to carry out the copolymerization at temperatures of 40° C. and below by using redox systems. Suitable starter systems are, for example, mixtures of peroxydisulphates and reducing sulphur compounds, such as bisulphites or thiosulphates, or combinations of diacyl peroxides with tertiary amines. The known chain transfer agents based on mercapto compounds or aliphatic aldehydes can be used to adjust the molecular weights or the molecular weight distributions.

The customary anionic, cationic or non-ionic emulsifiers and combinations of ionic and non-ionic emulsifiers can be used to stabilize the dispersions according to the invention and also to prepare the monomer emulsions.

Examples of the cationic emulsifiers employed are quaternary ammonium and pyridinium salts, for example stearyldimethylbenzylammonium chloride or N,N,N-trimethyl-N-perfluorooctanesulphonamidopropylammonium chloride.

Examples of anionic emulsifiers are alkylsulphonates, alkylarylsulphonates, fatty alcohol sulphates or sulphosuccinic acid esters, and furthermore emulsifiers containing perfluoroalkyl groups, such as ammonium or tetraethylammonium salts of perfluorooctanesulphonic acid or the potassium salt of N-ethyl-N-perfluorooctanesulphonylglycine.

The storage stability of the copolymer dispersions, in particular, is increased by non-ionic emulsifiers.

Examples of non-ionic emulsifiers are polyglycol ethers, for example ethylene oxide/propylene oxide copolymers, including those having a block structure, as well as alkoxylation products, in particular ethoxylation products, of fatty alcohols, alkylphenols, fatty acids, fatty acid amides and sorbitol monooleate.

In a preferred embodiment, the polymerization of (I), (II) and (III) is carried out in the presence of (IV), and if appropriate (V) and/or (VI). (V) and (VI) are preferably employed here in the form of aqueous dispersions.

The dispersions according to the invention are outstandingly suitable for the treatment of naturally occurring and synthetic materials, such as leather, paper, fibers, filaments, yarns, nonwovens and woven and knitted fabrics, in particular carpets, made of, in particular, cellulose and its derivatives, and also of polyester, polyamide and polyacrylonitrile materials, wool or silk, to which the dispersions according to the invention impart oleophobic and hydrophobic properties.

The dispersions according to the invention can also be employed in combination with other fluorinecontaining or fluorine-free dispersions.

For finishing carpets, the copolymers and graft copolymers according to the invention are used in the form of aqueous dispersions containing the ester compounds employed according to the invention, preferably in combination with aqueous colloidal suspensions of organosiloxanes, such as are described, for example, in DE-A-3,307,420, and if appropriate additionally in combination with other fluorine-containing dispersions.

Surprisingly, it has now been found that the dispersions according to the invention, show significantly improved oleophobizing and hydrophobizing effects on the substrates finished with them, such as textiles, leather and paper.

Naturally occurring and synthetic materials, such as leather, paper, fibers, filaments, yarns, nonwovens and woven and knitted fabrics, in particular carpets, made of, in particular, cellulose and its derivatives, and also of polyester, polyamide and polyacrylonitrile materials, wave or silk can successfully be given an oleophobic and hydrophobic finish using the dispersions according to the invention.

When dispersions according to the invention which have been prepared by adding the abovementioned ester compounds are used, improved oleophobizing and hydrophobizing properties can be achieved without the content of perfluoro-containing components, which are decisive for these properties, in the dispersion having to be increased.

The customary oleophobic and hydrophobic finish compositions can achieve this technological level only with a significant increase in the content of perfluorocontaining component in the latex, whereupon disadvantages, such as hardening and sticking on the materials finished with these compositions occur and, for example, have an adverse effect on properties such as the handle of textiles finished with these compositions. The disadvantages described can be avoided by using the copolymer dispersions according to the invention.

The finishing is carried out by known processes, such as, for example, exhaust or pad-mangling processes, for example between room temperature and 40° C., and also by slop-padding, spraying or foam application with subsequent temperature treatment at 80° to 180° C., preferably 120° to 150° C.

EXAMPLES

Example A

Emulsification of glycerol monooleate 240 parts by weight of glycerol monooleate (mixture of about 50% of monoglyceride and about 38% of di- and 12% of triglyceride) are stirred in a 2 liter vessel with a ground glass flange and with a stirrer with a ground glass flange, together with 7.2 parts by weight of $C_{12}$–$C_{14}$-alkyldimethylbenzylammonium chloride (about 50% strength in water) and 4.8 parts by weight of an oleyl alcohol-ethylene oxide adduct containing about 56 ethylene oxide units at 70° C for 30 minutes, so that a homogeneous oil phase is present. The stirrer is replaced by an ULTRA-TURRAX dispersing apparatus and 1,008 parts by weight of deionized water (temperature: 60° to 70° C.) are added dropwise in the course of 45 to 60 minutes (speed of rotation of the dispersing apparatus: 10,000 revolutions per minute). A stable, approximately 20% strength aqueous emulsion having particle sizes of 0.1 to 0.6 μm is obtained.

Example B

Emulsification of glycerol trioleate

Glycerol trioleate is emulsified by the same process as described in Example A.

| | | | |
|---|---|---|---|
| Mixture: | 240 | parts by weight | of glycerol trioleate |
| | 24 | " | 2-ethylhexanol-propylene oxide-ethylene oxide adduct (8 propylene oxide units, 6 ethylene oxide units) |
| | 1,056 | " | deionized water |

A stable, approximately 20% strength aqueous emulsion is obtained.

Example C

Emulsification of sunflower oil 300 parts by weight of sunflower oil are stirred with 28.5 parts by weight of a $C_{12}$–$C_{13}$-alkyl alcoholethylene oxide adduct (about 4 mol of ethylene oxide) and 1.5 parts by weight of a reaction product of castor oil with about 30 mol of ethylene oxide at 60° C. for 30 minutes, so that a homogeneous oil phase is present.

1,200 parts by weight of deionized water of 60° C. are agitated mechanically by an ULTRA-TURRAX dispersing apparatus (10,000 revolutions per minute) in a 2 liter vessel with a ground glass flange. The organic phase is metered into this initial component in the course of about 30 minutes via a dropping funnel which can be heated (60° C.). The dispersing apparatus is finally allowed subsequently to run for a further 5 minutes.

The solids content in the finished emulsion is about 21.5%.

Example 1

The following solution is prepared at room temperature and stirred for 15 minutes:

| Solution 1 | | |
|---|---|---|
| 143.1 | parts by weight | of an emulsion prepared according to Example A |
| 10.25 | " | of an ethoxylated nonylphenol containing 10 ethylene oxide units |
| 4.16 | " | benzyldodecyldimethylammonium chloride. |

540 parts by weight of deionized water are then added and the solution is heated to 50° C., while stirring.

Solution 2 is prepared at 50° C. and solution 3 is prepared at 30° C.

| Solution 2 | | |
|---|---|---|
| 430 | parts by weight | of ethyl acetate |
| 43.4 | " | N-methyl-N-perfluorooctane-sulphonamidoethyl methacrylate |
| 12.7 | " | stearyl methacrylate |
| 18.45 | " | vinyl acetate |
| Solution 3 | | |
| 0.918 | parts by weight | of dilauroyl peroxide |
| 0.267 | " | tert.-butyl perpivalate |
| 6.4 | " | ethyl acetate |

Solutions 1 and 2 are brought together at 50° C. and emulsified in an emulsifying machine at 40° to 50° C. until the particle size is constant. The resulting emulsion is introduced into a reactor equipped with a stirrer, reflux condenser and internal thermometer and is allowed to cool to 30° C. Solution 3 is then metered in at 30° C. and the mixture is stirred at 30° to 40° C. for 15 minutes. It is then heated to 60° C. in the course of half an hour and stirred at 60° to 70° C. for one hour. It is then allowed to react at 70° to 80° C. for three hours, during which the ethyl acetate is distilled off over an additionally attached distillation apparatus. The mixture is subsequently stirred at 83° to 85° C. for a further two hours and at 85° to 90° C. for three hours.

| | |
|---|---|
| Solids content: | 14.4% |
| Fluorine content in the solid: | 20.1% |
| Average particle size: (by light scattering) | 367 nm |

Example 2 a) The following solution is prepared at room temperature and stirred for half an hour.

| Solution 1 | | |
|---|---|---|
| 143.1 | parts by weight | of an emulsion prepared according to Example A |
| 10.25 | " | of an ethoxylated nonylphenol containing 10 ethylene oxide units |
| 4.16 | " | of benzyldodecyldimethylammonium chloride. |

-continued 540 parts by weight of deionized water are then added and the solution is heated to 50° C., while stirring.

Solution 2 is prepared at 50° C. and solution 3 is prepared at 30° C.

| Solution 2 | | |
|---|---|---|
| 450 | parts by weight | of ethyl acetate |
| 43.4 | " | N-methyl-N-perfluoro-octanesulphonamidoethyl methacrylate |
| 12.7 | " | stearyl methacrylate |
| 18.45 | " | vinyl acetate |
| 14.63 | " | graft base according to Example 2b$_1$) |
| Solution 3 | | |
| 0.918 | parts by weight | of dilauryl peroxide |
| 0.267 | " | tert.-butyl perpivalate |
| 6.4 | " | ethyl acetate |

Solutions 1 and 2 are brought together at 50° C. and emulsified in an emulsifying machine at 40° to 50° C. until the particle size is constant. The resulting emulsion is introduced into a reactor equipped with a stirrer, reflux condenser and internal thermometer and is allowed to cool to 30° C. Solution 3 is then metered in at 30° C. and the mixture is stirred at 30° to 40° C. for half an hour. It is then heated to 60° C. in the course of half an hour and stirred at 60° to 70° C. for one and a half hours. It is then allowed to react at 70° to 80° C. for three hours, during which the ethyl acetate is distilled off over an additionally attached distillation apparatus. The mixture is subsequently stirred at 85° C. for a further three hours and at 85° to 90° C. for one hour.

| | |
|---|---|
| Solids content: | 15.4% |
| Fluorine content in the solid: | 17.9% |
| Average particle size: (by light scattering) | 225 nm |

b) Preparation of the graft base Melamine condensation products which can be used as the graft base, such as are described, for example, in DE-A-3,800,845 and in U.S. Pat. No. 2,398,569, can be obtained, for example, by reacting methylol products of aminotriazines or etherification and esterification products thereof with, for example, aliphatic carboxylic acids and with amines in the context of a polycondensation. For this, the carboxylic acid can first be reacted with the melamine derivative and the amino component can then be reacted (see DE-A-956,990). A graft base which is prepared is, for example:

b$_1$) a mixture of 50% by weight of a condensation product prepared from 1 mol of hexamethylolmelamine pentamethyl ether, 1.5 mol of behenic acid and 0.9 mol of N-methyldiethanolamine at 130° C. for 3 hours, and 50% by weight of paraffin of melting point 52° C.;

b$_2$) a polycondensate which is obtained by melting 3 mol of an industrial fatty acid which consists to the extent of about 50% of $C_{22}$-, about 40% of $C_{20}$-, about 5% of $C_{18}$- and to the extent of about 5% of other carboxylic acids at 80° C., adding 1 mol of hexamethoxymethylmelamine and reacting the components at 160° to 190° C. for 24 hours.

Example 3

The preparation is carried out as described in Example 2a) using the solutions mentioned therein, with the only difference that solution 2 contains 7.32 parts by weight of a prepared condensation product $b_2$) instead of the graft base $2b_1$).

| | |
|---|---|
| Solids content: | 16.8% |
| Fluorine content in the solid: | 18.9% |

Example 4

The copolymer dispersion is prepared as described in Example 2a), with the only difference that the emulsion of glycerol monooleate prepared according to Example A is not added to solution 1 but is added, in the same amounts as described under Example 2a), only after the polymerization and distillation of the finished copolymer dispersion have been carried out.

| | |
|---|---|
| Solids content: | 15.3% |
| Fluorine content in the solid: | 17.9% |

Example 5 (Comparison)

The preparation is carried out as in Example 2a) using the solutions mentioned therein, with the only difference that solution 1 contains no aqueous emulsion, prepared according to Example A, of an ester compound to be employed according to the invention.

| | |
|---|---|
| Solids content: | 14.4% |
| Fluorine content in the solid: | 22.8% |
| Average particle size: (by light scattering) | 471 nm |

Example 6

The preparation is carried out as in Example 2a) using the solutions mentioned therein, with the only difference that, instead of an aqueous emulsion, prepared according to Example A, of an ester compound, solution 1 contains the same amount of an emulsion prepared according to Example B.

| | |
|---|---|
| Solids content: | 15.5% |
| Fluorine content in the solid: | 17.9% |
| Average particle size: (by light scattering) | 295 nm |

Example 7

The preparation is carried out as in Example 2a) using the solutions mentioned therein, with the only difference that, instead of an aqueous emulsion, prepared according to Example A, of an ester compound, solution 1 contains the same amount of an emulsion prepared according to Example C.

| | |
|---|---|
| Solids content: | 16.5% |

-continued

| | |
|---|---|
| Fluorine content in the solid: | 17.9% |

Example 8

The preparation is carried out as in Example 2a) using the solutions mentioned therein, with the only difference that, instead of the aqueous emulsion, prepared according to Example A, of an ester compound, solution 1 contains 28.7 g of linseed oil.

| | |
|---|---|
| Solids content: | 18.2% |
| Fluorine content in the solid: | 17.5% |

Example 9 (Use)

An aqueous dispersion is prepared according to Example 1. 40 parts by weight of this dispersion are mixed with 60 parts by weight of an aqueous colloidal suspension of organosiloxanes such as are described in DE 3,307,420.

A 2.5% strength aqueous dilution of this mixture is applied (spray application) to a polyamide carpet (tufted goods of 30% residual moisture, pile weight: 500 g/m$^2$) so that an add-on level of 1% by weight of the abovementioned mixture (based on the pile weight) remains on the carpet.

The carpet is then dried at 125° to 150° C. for 5 to 15 minutes, condensation is carried out, the carpet is climatically controlled at 23° C. and 65% relative atmospheric humidity for 24 hours and the technological tests are then performed.

Dispersions prepared according to Example 2 to 8 were used analogously for finishing polyamide carpets.

The results of the technological tests can be seen from Table 1.

TABLE 1

| | Oleophobicity[1)] | Hydrophobicity[2)]. |
|---|---|---|
| Example 1 | 3–4 | 60/40–50/50 |
| Example 2 | 5 | 20/80 |
| Example 3 | 4–5 | 30/70–20/80 |
| Example 4 | 5 | 20/80 |
| Example 5 | 2 | 60/40 |
| Example 6 | 5 | 20/80 |
| Example 7 | 2–3 | 30/70–20/80 |
| Example 8 | 3–4 | 40/60–30/70 |

[1)]According to AATCC test method 118 (5 better than 4)

[2)]Stability towards aqueous-isopropanolic solutions (water/isopropanol - 60/40 better than 70/30)

Compared with a copolymer dispersion which has been prepared without the ester compounds used according to the invention (Example 5), the copolymer dispersions according to the invention show a significant improvement both in the oleophobizing and in the hydrophobizing action. The soiling characteristics of carpets finished with these copolymer dispersions are likewise improved and meet increased requirements.

What is claimed is:

1. Aqueous dispersions of copolymers or graft copolymers of ethylenically unsaturated perfluoroalkyl monomers having at least 6 C atoms in the perfluorinated chain selected from the group consisting of compounds corresponding to the formula $$C_nF_{2n+1}-(CH_2)_m-O-\overset{O}{\overset{\|}{C}}-\overset{R_2}{\overset{|}{C}}=CH_2$$

$$C_nF_{2n+1}-SO_2-\underset{\underset{R_1}{|}}{N}-CH_2-\overset{R_2}{\overset{|}{CH}}-O-\overset{O}{\overset{\|}{C}}-\overset{R_2}{\overset{|}{C}}=CH_2$$

and $$C_nF_{2n+1}-O-(CH_2)_m-O-\overset{O}{\overset{\|}{C}}-\overset{R_2}{\overset{|}{C}}=CH_2$$

wherein $R_1$ denotes $C_1$–$C_4$-alkyl, $R_2$ denotes hydrogen or methyl, m denotes 1 to 4 and n denotes 4 to 12 and ethylenically unsaturated monomers containing no perfluoroalkyl groups, characterized in that the dispersions additionally contain ester compounds which contain at least 6 C atom linked linearly to one another and either contain 1,2-substituted vinylic groups or are free from vinylic groups selected from the group consisting of a) synthetic or naturally occurring esters and/or partial esters of saturated, unsaturated and/or substituted fatty acids of chain length $C_6$–$C_{22}$ with mono-, di-, tri- and polyols, b) esters and/or partial esters of di-, tri- and tetracarboxylic acids with saturated or unsaturated fatty alcohols of chain length $C_6$–$C_{22}$, and c) polyesters based on polyhydric alcohols and polybasic carboxylic acids having molecular weights of about 1,000 to 8,000.

2. Aqueous dispersions according to claim 1, characterized in that the monomers containing no perfluoroalkyl groups correspond to the formulae $$CH_2=\overset{R_3}{\overset{|}{C}}-\overset{O}{\overset{\|}{C}}-OR_4 \qquad \text{(II)}$$

and

-continued $$CH_2=\overset{R_3}{\overset{|}{C}}-\overset{O}{\overset{\|}{C}}-OR_5 \qquad \text{(IIIa)}$$

or $$CH_2=\overset{R_3}{\overset{|}{C}}-\overset{O}{\overset{\|}{C}}-NHR_6 \qquad \text{(IIIb)}$$

or $$CH_2=\overset{R_7}{\overset{|}{C}}-R_8 \qquad \text{(IIIc)}$$

wherein $R_3$ denotes hydrogen, methyl or fluorine and $R_4$ represents a $C_8$–$C_{22}$-alkyl radical, $R_5$ denotes $C_1$- to $C_7$-alkyl, $R_6$ denotes $C_1$- to $C_7$-alkyl,

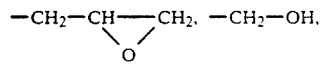

$-CH_2-CH-CH_2$, $-CH_2-OH$, $-CH_2-OCH_3$ or $-CH_2-O-\overset{O}{\overset{\|}{C}}-CH_3$, $R_7$ denotes H, $CH_3$, F or Cl, and $R_8$ denotes Cl, F, $OR_1$, phenyl, $-O\overset{O}{\overset{\|}{C}}R_9$ or CN and $R_9$ denotes $C_1$–$C_4$-alkyl.

3. Aqueous dispersions according to claim 1 characterized in that the comonomers containing no perfluoroalkyl groups are vinyl esters or acrylic and methacrylic esters of $C_1$–$C_4$-alkanols and acrylic and methacrylic esters of $C_{12}$–$C_{22}$-alkanols.

4. Aqueous dispersions according to claim 1, characterized in that hydrophobic vinyl polymers and/or polycondensates are employed as the graft base.

5. Aqueous dispersions according to claim 1, characterized in that the content of non-copolymerized ester compounds having at least 6 C atoms additionally contained in the dispersions is 2 to 50% by weight, preferably 5 to 35% by weight, based on the monomers employed.

* * * * *